United States Patent [19]

Bellini

[11] Patent Number: 4,648,234

[45] Date of Patent: Mar. 10, 1987

[54] AUTOMATIC BAG-LOADING ATTACHMENT FOR ROTARY BAG-FILLING MACHINES

[76] Inventor: Enrica Bellini, Via San Gottardo, Castione CH-6532, Switzerland

[21] Appl. No.: 225,260

[22] PCT Filed: Apr. 22, 1980

[86] PCT No.: PCT/CH80/00046

§ 371 Date: Jan. 15, 1981

§ 102(e) Date: Jan. 15, 1981

[87] PCT Pub. No.: WO80/02409

PCT Pub. Date: Nov. 13, 1980

[30] Foreign Application Priority Data

May 8, 1979 [CH] Switzerland ..... 4284/79

[51] Int. Cl.[4] ..... B65B 43/50

[52] U.S. Cl. ..... 53/67; 53/25; 53/386; 53/571; 141/68; 141/114; 141/166

[58] Field of Search ..... 53/384, 386, 571, 573, 53/67, 253, 564, 570; 141/68, 114, 166

[56] References Cited

U.S. PATENT DOCUMENTS

| | | | |
|---|---|---|---|
| 3,213,588 | 10/1965 | Peterson | 53/384 X |
| 3,312,038 | 4/1967 | Knauf | 53/573 |
| 3,884,278 | 5/1975 | Nakashima | 53/571 X |
| 3,952,479 | 4/1976 | Achelpohl | 53/386 X |
| 4,213,287 | 7/1980 | Knorr | 53/573 |

*Primary Examiner*—E. R. Kazenske
*Assistant Examiner*—Michael D. Folkerts
*Attorney, Agent, or Firm*—Saul Jecies

[57] ABSTRACT

An automatic bag-loading apparatus for placing valve bags onto the spouts of a bag-filling machine. The apparatus comprises a carousel with carrier arms equipped at their ends with grippers to grip and hold bags. Synchronizing means are mounted to the bag-filling machine to encounter the bag-carrying grippers and to guide them through appropriate channels towards the spouts, thereby synchronizing the relative speed between the bag-filling machine and the carousel.

13 Claims, 9 Drawing Figures

AUTOMATIC BAG-LOADING ATTACHMENT FOR ROTARY BAG-FILLING MACHINES

TECHNICAL FIELD OF THE INVENTION

The invention relates to an automatic bag-loading apparatus for placing valve bags onto the spouts of a bag-filling machine.

BACKGROUND OF THE INVENTION

Rotary bag-fillers have been proposed having several beaks or spouts for granular, powdery or similar materials. These machines consist essentially of a generally cylindrical silo that revolves on its base. On the outside walls are a series of bagging stations that basically consist of spout or beak bag-fillers upon which self-closing valve bags are placed and having also weighing stations by which the exit of material from the spout is shut off when the desired weight is reached. The bag is then expelled and moved away by conventional means.

For these machines to function, one or more workers are required placed near the bag loading area who must take the bags from the pile, open the bag valve by hand as well as place the bag onto the filler spout.

Certain machines are known that place the bag onto the spout automatically, however, these machines have a complicated device for each spout enabling the spout to assume two positions: one, at a tangent to the rotation of the bagging machine that corresponds to the in motion placement position of the bag and a radial position from which the bag may be filled with material.

It is known that these devices apart from the fact that they must be constructed with the bagging machine-given that they form a part of the bagger (spout or beak)-, have various disadvantages, particularly in the case of a stuck bag-valve. They are not very reliable in operation owing to the way in which they operate which causes a jolt each time a stationary bag is caught up by a moving spout.

SUMMARY OF THE INVENTION

It is an object of the present invention to provide a simply made and precise bag loading device consisting essentially of a carousel that carries bag-placing grippers at the ends of a set of arms. This carousel is caused to rotate by the bag filling machine itself by means of a synchronizing mechanism mounted near the spout and capable of carrying with it the bag-placing gripper, accelerating the rotation of the carousel and guiding the said gripper provided with a bag face to face with the spout. The placing only takes place when the spout and the bag gripper are moving at the same rotational speed.

Such a device according to the invention can be used with any type or size of bag filler, new or old, without any significant modification. That is to say, one must only adapt the relative axis position of the rotation and the length of the guide arms to the diameter and the number of spouts of the bag filler being used.

The illustrations appended hereto serve to clarify this description by indicating those parts that make up the attachments of the invention and its various working operations. They give a clearer idea and better understanding of the invention in particular by limiting each drawing to the essential parts of the apparatus.

Certain conventional parts and items have not been described or indicated in the illustrations (valves, pipes, motors) which control the movement of the various components, likewise the schematics or the devices (relays, microswitches, etc.) which control the various movements which the machine must execute during the sequence, since they are only a basic set of electro or mechanical pieces of equipment used during the functioning cycle of this machine in operation.

In the following a preferred embodiment of the invention is described with particular reference to the accompanying drawings.

DESCRIPTION OF THE PREFERRED EMBODIMENT

Figure 1:
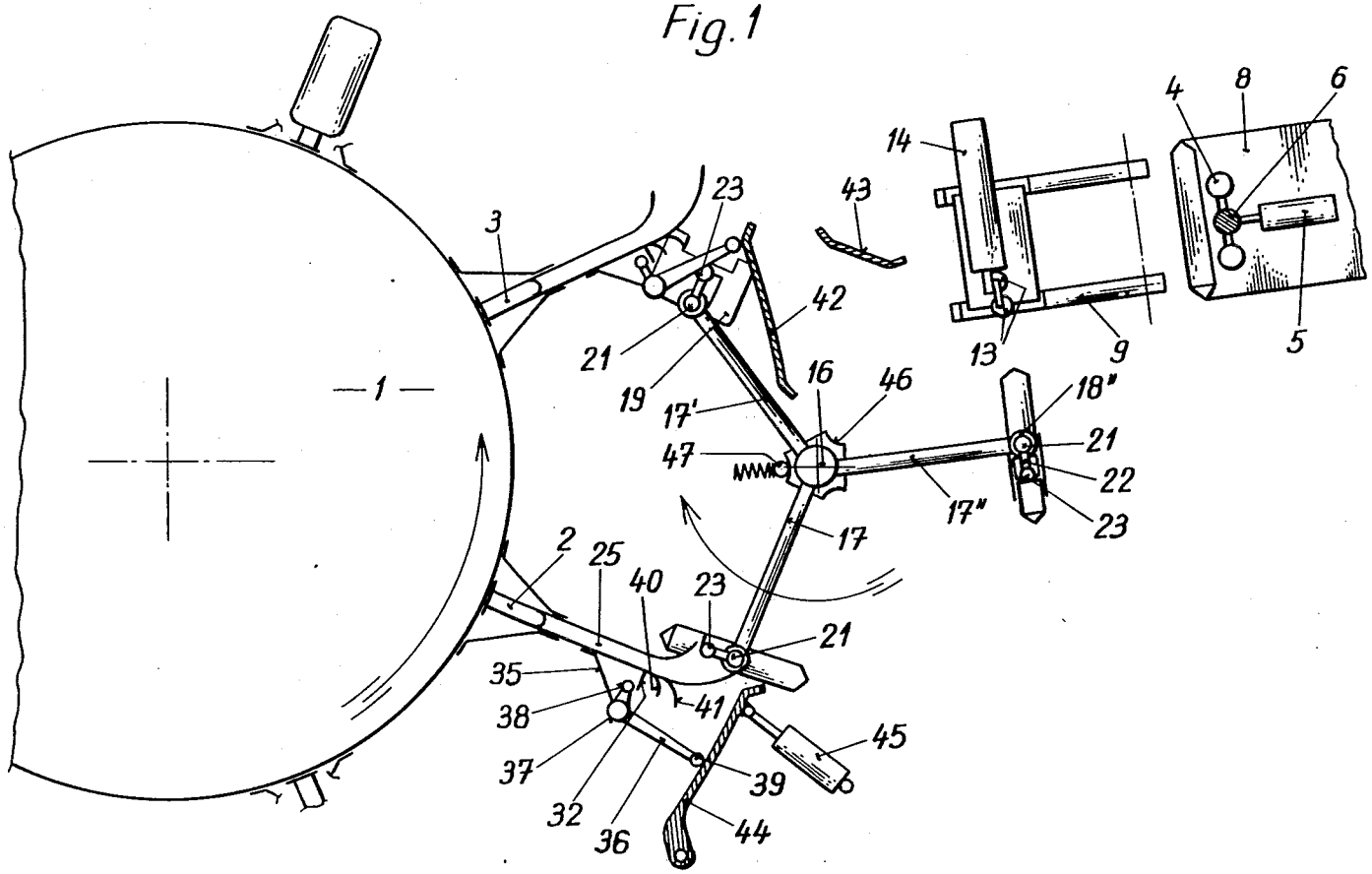
FIG. 1 shows a machine according to the invention from above during the gripping phase with the bagging stations of the bagger.
Figure 2:
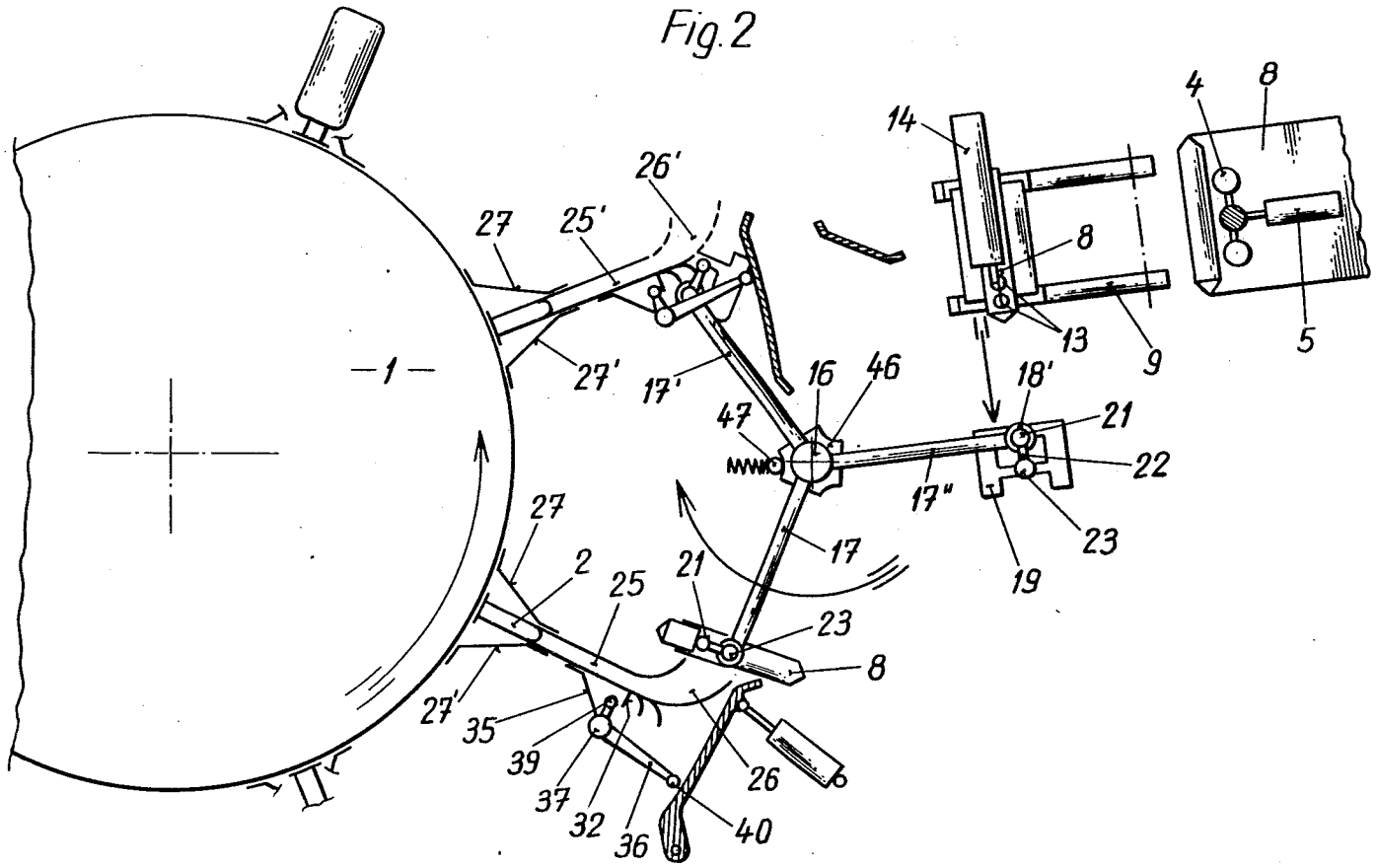
FIG. 2, shows the same machine from above, but during the set down or release phase of the same bagging station of the bagger.
Figure 3:
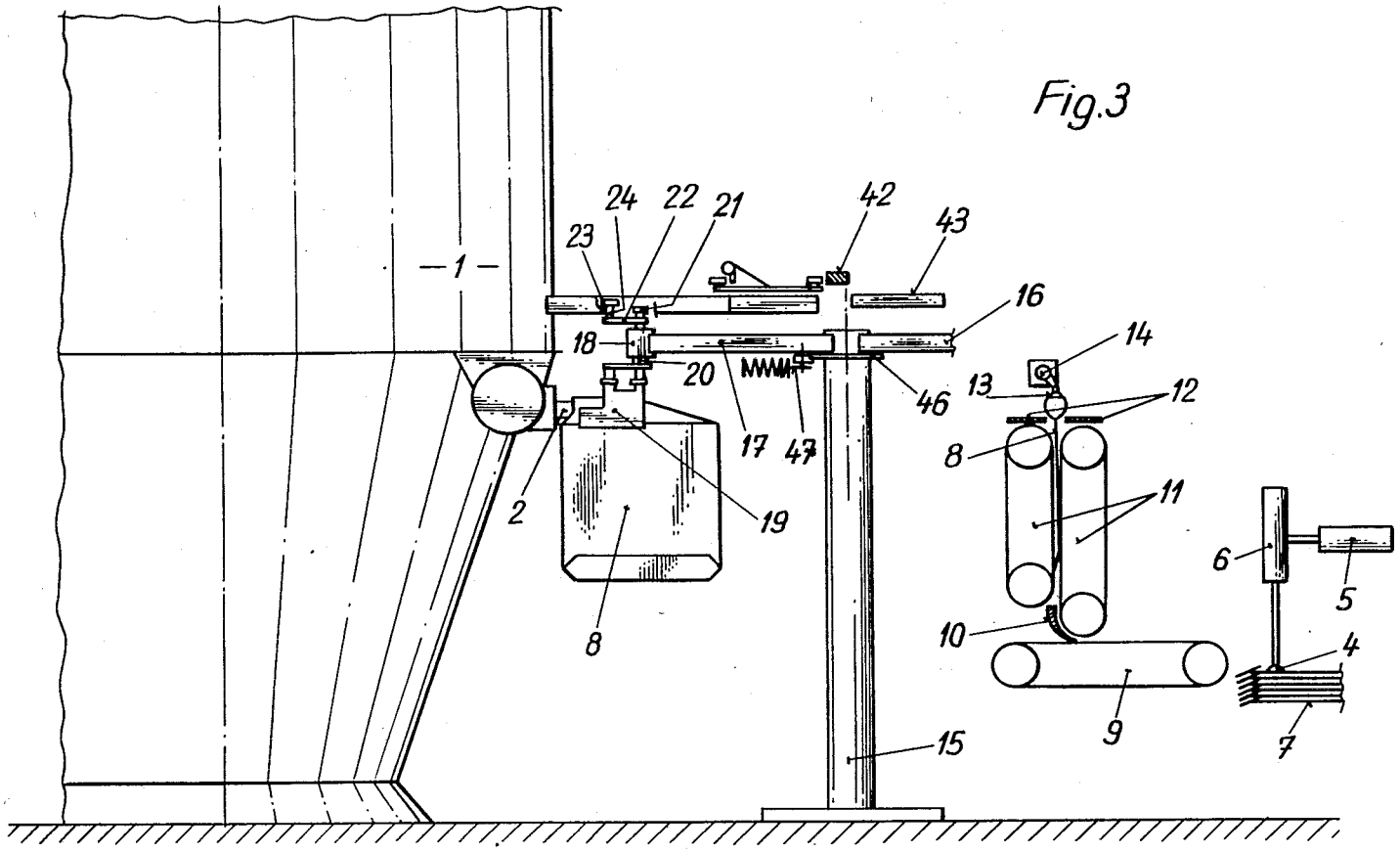
FIG. 3, shows a side view of the machine during the placing of a bag onto the spout, which is in practice the intermediate position between the positions according to FIGS. 1 and 2.
Figure 4:
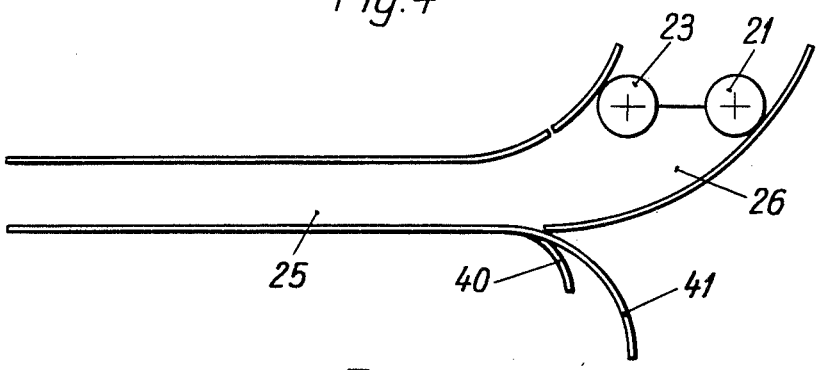
FIGS. 4 and 5 indicate two positions that the guide organ of the bag-placing gripper assumes during the contact phase due to the synchronizer in its acceleration phase which causes the placing of a bag.

With reference to FIGS. 1–9 (schematically and partially) we indicate as 1 any known type of rotary bagger that has various filling posts, of which we have indicated only two or three in FIGS. 1, 2, and 3, and in particular respectively the loading beaks or spouts 2 and 3.

In front of the bagger and near the area where the bags are to be placed (depending on the cycle) the bag-placing apparatus is positioned consisting essentially of:

- a device to remove bags from the pile,
- a device for prepositioning the bag, to grip it and to guide it towards the bag-placing gripper threader
- a bag-placing device composed of a carousel with arms and claws that grip and place the bags.
- synchronizing devices mounted on the bagging machine near each spout or beak.

The device for removing the bags from the pile is composed essentially of a suction cup element 4 mounted on two pistons 5 and 6 that enable the cup to make two movements: the one up and down and the other forwards and backwards. Its function is to pick up a bag 8 from the bag pile 7 and to feed it to the prepositioning device.

This device is similar to the device described in the Italian patent Application No. 23018 A/76 of Ventomatic s.p.a. which corresponds to French Pat. No. 2,350,258. This prepositioner essentially comprises a belt conveyor 9 which both receives and guides the bags towards the prepositioner itself which is composed of:

- a deflector 10 which turns the head of the bag through 90 degrees
- a vertical belt conveyor 11 and a bag stopping and holding devices 12, the former comprising a sensor element (not shown) such as a photo-electric cell or similar means, that stops the vertical conveyor whenever the mouth of a bag has passed the bag stopping and holder device, the latter being composed of two claws, one of which is fixed and the other of which is powered by a piston which operates in such a way as to push intermittently below the mouth of the bag at the same time as causing a slight reverse movement on the conveyor so that the head of the bag is forced into a horizontal position.

This corresponds in manufacturing character and function to the similar device described in the above-mentioned Italian Patent. The device to grip and guide the bag towards the bag-placing gripper consists basically of suction cups 13 that grip the head of the bag to prepare the opening of the valve and a piston device 14 that causes the cups to move up and down in order to take the upper side of the mouth of the bag that is held by the claws 12 and thus opens the valve. At the same time it also has a forwards and backwards motion according to the arrow in FIG. 2, that moves the bag towards the bag-placing gripper threader.

The bag-placing device is composed of:

the carousel, formed by a vertical axle 15 that is fixed to the floor facing the bag loading zone of the bag-placing device on top of which is set a freely revolving element. This element has three arms positioned 120° apart (17, 17', 17'') from each other, each having a sleeve (18, 18', 18'') at its extreme end.

the grippers for gripping and placing the bags mounted on revolving axles in said sleeves (18, 18', 18'').

The gripper is essentially made up of two claws 19 that open or close on command upon the mouth of the bag with an open valve, a valve which may be activated by any known means (mechanical, pneumatic, etc), which can hold it open. It will be in an open position when the carrying arm is in the position of the arm 17'' in FIG. 2. It then closes on the bag as in FIGS. 1 & 3 in order to keep the valve open. It enters the synchronizer (see FIG. 1) and stays there until it has placed the bag onto the spout (see FIG. 3). It then opens again (see FIGS. 1 and 2, arm 17') during the release phase of the synchronizer.

The gripper is mounted on the corresponding arm 17 and is fixed at one end of an axle 20 passing through the sleeve 18 and capable of turning therein and equipped with a roller 21 at its other end. At the opposite end of the axle 20, below the roller 21, there is a small arm 22 parallel to the gripper 19 and bearing at its opposite end, on top of a small axle 24, a second roller 23 situated on a higher level than the previous roller 21. These rollers serve to guide the gripper 19 and lead it in the right direction, according to the position that it must assume, as any angular movement of the roller 23 corresponds equally to the angular movement of the gripper 19.

the synchronizer (see particularly FIGS. 8 and 9), essentially a inverted 'U' guide channel, made of two sections, a first straight one 25 and a second conically curved one 26 placed as a continuation of the front end of the straight section.

The synchronizer is mounted, by means of supports 27 and 27', at the opposite end of its straight section to the external wall of the bagger, above the spout 2 or 3 so that their respective horizontal axes pass the same vertical level. The curved section is mounted and placed directly behind the straight section by supports 27 welded on the upper end portion of the straight channel and carrying at their sleeve 28 in which turns an axle 29. On the ends of this axle are mounted a sleeve 30 which carries supports 31 and 32 and a sleeve 33 which carries a support 34. The supports 31 and 34 are welded to the upper surface of the curved section 26 of the said synchronizer.

The support 32 projects laterally from the synchronizer. On the side of the straight section of the synchronizer, on the side where the support 32 projects, an 'L' lever 36 is attached by means of a support 35 and carrying at its extremities two rollers 38 and 38. The roller 39 is at the same horizontal level as the support 32 so that it pushes on the support and in this way causes an angular rotation of the front of the curved section of the synchronizer in order to lift it, because in this position it no longer interferes with the guide rollers 21 and 23 of the bag-placing gripper. Also on the exterior lateral side of the straight section of the synchronizer are placed two curved projections 40 and 41. These are set at two super-imposed positions that correspond to the two levels of the guide rollers 21 and 23 of the bag-placing gripper. Corresponding to the release zone of the gripper from the synchronizer is a fixed cam 42 which acts on the roller 39 of lever 36 in order to lift the curved section of the synchronizer to cause the guide rollers of the gripper to not come into contact with the curved section but on the contrary, that they may come into contact with the curved projections 40 and 41 in order to place the gripper 19 in the closest possible position to the bag reception position. This position is successively defined and corrected by a second fixed cam 43 placed in front. On the other hand, corresponding to the entry zone of the gripper entry into the synchronizer is placed a cam 44 that is controlled by a piston 45 which is activated by a control circuit 48 e.g. a sensor circuit and in its rest position does not interfere with roller 39 of lever 36. If for any reason (obstruction in the bag-loading area, unreached weight, etc.), a bag remains on the spout, the control circuit activates the piston, section 26 of the synchronizer is elevated and is moved out of the path of the bag-placing device. Finally, in order to guarantee the precise position of the arms 17 during the bag transport phase, a cam plate 46 is placed on the carousel axle 15 against which a spring powered roller 47 impinges in such a way that when the carousel is not subjected to the pull of the synchronizer, it stays in the desired position due to the engagement of said elements 46 and 47.

The functioning of the bag loader in operation will now be described in more detail:

The bagger 1 turns on its own power in the direction of the arrow.

By the bag-lifting device the bag 8 is picked up from the package 7 and placed by the suction cups onto the conveyor belt 9 which conveys them to the prepositioning device. Here, the bag is placed vertically, valve end up, in a flat position and blocked by the claws 12. At this time the bag-gripping device comes into action. The bag is held back by the claws 12 that close under the mouth of the bag to allow the suction cups 13 to approach and take the upper part of the mouth and pull it upwards, thus opening the valve. The claws 12 then open and the device 14 places the bag under the opened claws 19 of the arm 17' of the bag-placing gripper which is at this moment stopped in front of the positioning device holding its position due to the engagement of one cavity of cam 46 with the stop roller 47.

We say that the gripper is stopped because, as can be seen in FIG. 2, none of the items of the bag-placing device has contact with the synchronizing device, albeit only in this short time span. The claws 19 close on the bag, the suction cups detach and return for the next operation. When the carousel begins to rotate again, see FIG. 1, the front part 26 of the synchronizer device that is mounted on the approaching spout (no. 2 accoring to FIG. 1) engages the guide rollers 21 and 23 of the arm 17 that is already carrying a bag because of the above operation. The carousel 16 accelerates its rotation up to the synchronization speeed which is reached when the gripper reaches the beginning of the straight section of the synchronizer FIG. 4.

Figure 5:
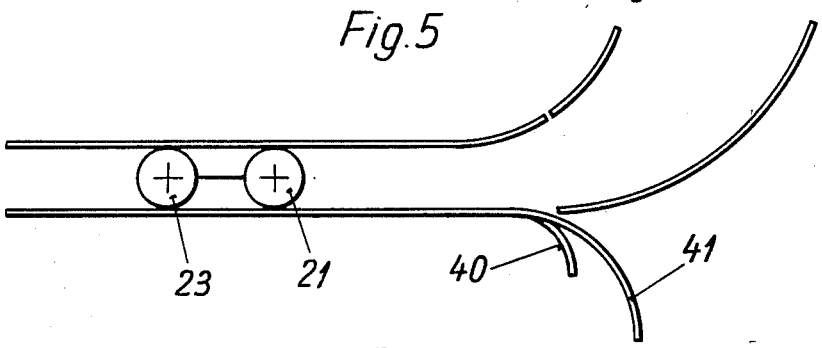

Having reached that speed, the relative movement between the spout and bag-carrying gripper continues on the same axis FIG. 5 until the valve FIG. 3 has been placed onto the spout 2 and the gripper opens 19.

Figure 6:
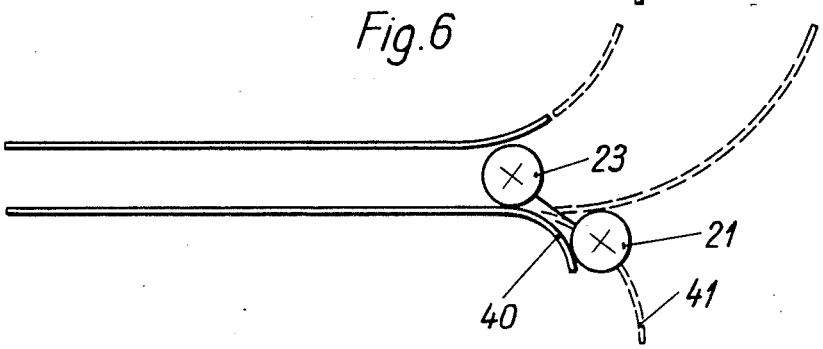
FIGS. 6 and 7 show two positions which the guide organs of the bag-placing gripper assume during the set down and release phases of the synchronizer after placement of the bag.
Figure 7:
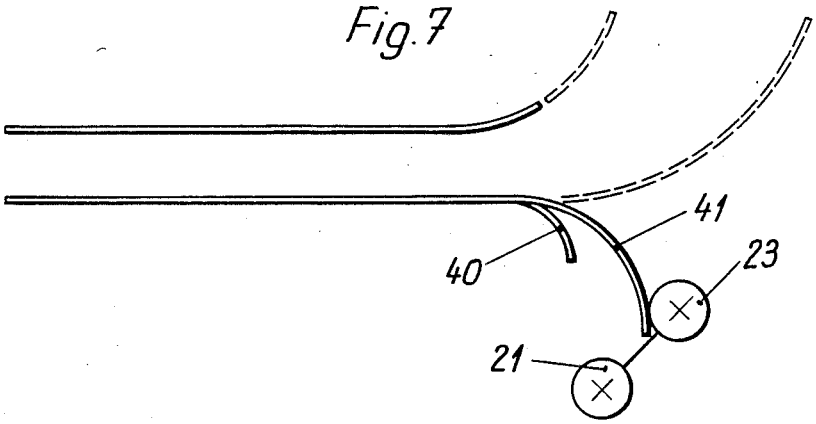
Figure 8:
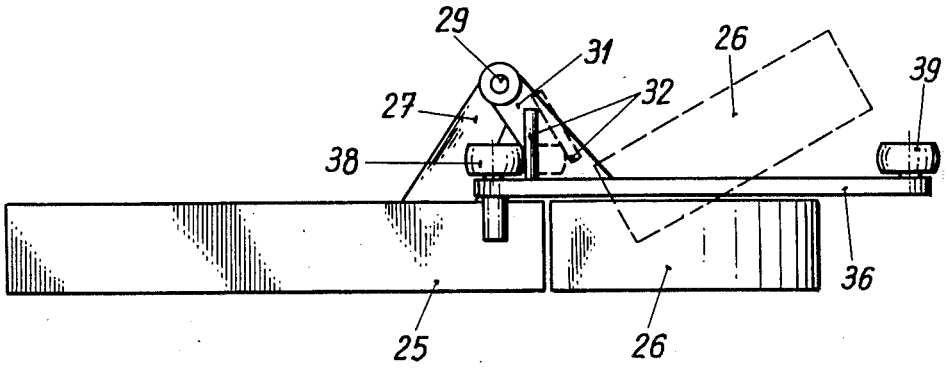
FIG. 8 is a plan view of the synchronizer means.
Figure 9:
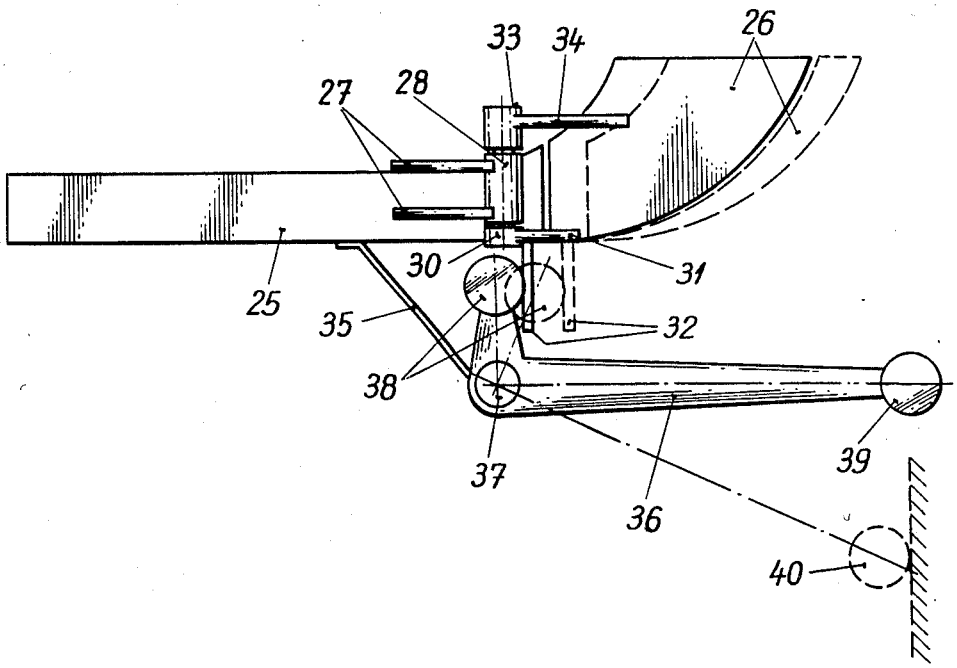
FIG. 9 is a side view of the synchronizer means.

Then begins the return phase of the gripper with a reverse movement until the synchronizer becomes disengaged FIG. 6 and 7 which happens due to the meeting of the roller 39 with cam 42, and the front part 26 of the synchronizer being lifted according to FIGS. 8 and 9.

At the same time, the projections 40 and 41 come into contact with the guide rollers 21 and 23 of the gripper 19, guiding them to the closest possible new bag reception position. This position becomes definitely corrected and defined by the successive encounter of rollers 21 and 23 with cam 43.

Then a new bag is loaded and another cycle begins.

If the arriving spout is already occupied by a bag, the piston 45 under command of an appropriate detector circuit announces the presence of a bag on the spout and pushes cam 46 forwards. The cam is active on lever 37 and causes (during the contact phase) the lifting of the front section 26 of the synchronizer, preventing an engagement with the gripper. This station passes on without engaging and the gripper awaits the next bagging station. From the preceding explanation, it is clear that the movement of the carousel 16 occurs due to the power of the bagger, following its engagement with the carousel of the bag-placing device because of the engagement of guide rollers 21 and 23 of the bag-placing grippers with the guide channel 25 and 26 of the synchronizer that is joined to the bagger as well as due to the fact that the bag transfer from the transporter 14 to the bag-placing gripper 19 occurs during the brief time span of non-contact, or that when the preceeding arm has become disengaged from the synchronizer and the following has not yet come into contact with it (see FIG. 2).

What I claim is:

1. An automatic bag-loading apparatus for placing valve bags onto the spouts of a bag-filling machine comprising a carousel structure;

means rotatably mounting said carousel structure, said carousel structure including carrier arms equipped at their ends with bag-placing grippers, said grippers having means to grip and hold the bags at their valve ends with open valves;

synchronizing means mounted on the bag-filling machine;

guiding means associated with the carrier arms to guide the bag-placing grippers; and channel means associated with the synchronizing means to receive and lead the guiding means towards the spouts of the bag-filling machine.

2. An automatic bag-loading apparatus according to claim 1 wherein each of the bag-placing grippers defines a horizontal axis, said guiding means comprising rollers vertically and laterally spaced from one another at the highest end of a vertical pivot axle that turns in a sleeve, the sleeves being mounted at the head of each arm of the carousel structure and with their lower ends connected to the bag-placing grippers, a first one of the rollers being situated on the pivot axle and a second one of the pair of rollers being placed on the head of a horizontally fixed pivot bar and parallel to the horizontal axis of the bag-placing grippers.

3. An automatic bag-loading apparatus according to claim 1, wherein said channel means comprise two inverted 'U' channels the first channel being straight and directly connected to the bag-filling machine and mounted above the axis of the spout, the second channel being placed as a continuation of the first channel and opening outwardly in conically curved manner, supported by the first channel.

4. An automatic bag-loading apparatus according to claim 3, wherein said second channel comprises elevating means to elevate said second channel by a given angle in respect to the contact point with the first channel so that it can engage the gripper rollers of the carousel structure when lowered or not engage them when elevated, the latter position occurring always upon returning of the grippers to a receiving position for picking up a further one of the valve bags or at intervals, whenever a bag is still attached on the arriving spout.

5. An automatic bag-loading apparatus according to claim 4, wherein said elevating means comprise 'L' lever means mounted on the synchronizing means for encountering fixed cam means which lift the second channel to allow the grippers to leave the synchronizing means and return to their receiving position.

6. An automatic bag-loading apparatus according to claim 4, wherein said elevating means comprises 'L' lever means mounted on the synchronizing means for encountering movable cam means activated by a piston controlled by a sensor circuit detecting the presence of a bag.

7. An automatic bag-loading apparatus according to claim 3 wherein said channel means comprise projections associated with said straight first channel to encounter said guiding means in order to guide the grippers towards their receiving position for picking up a further one of the valve bags.

8. An automatic bag-loading apparatus according to claim 1, further comprising valve opening and bag positioning means.

9. An automatic bag-loading apparatus according to claim 8 wherein said valve opening and bag positioning means comprise bag removing means to remove individual bags from a pile, including suction means to hold a bag and piston means to move the bag in two directions bag prepositioning means to position the bags and open the valves including claw means to hold the bags and suction means to open the bag valves.

10. An automatic bag-loading device, comprising, a carousel structure;

means rotatably mounting said carousel structure;

a rotary bag-filling machine cooperating with said carousel structure for rotating the latter;

an arm having a head located on said carousel;

a spout cooperating with said arm;

a bag-gripper on said arm for gripping and threading said mouth of said bag;

a bag-lifting device for placing said bag on a transporting device;

a prepositioning device for turning said mouth of said bag;

a bag-holding device for moving said mouth of said bag;

an additional transporting device for transporting said bag substantially at right angles to said transporting device for moving said bag to said bag-holding device;

means for reversing the movement of said additional transporting device; and a synchronizing device connected to said bag-filling machine for synchronizing the moving speed of operation of the parts of said carousel structure.

11. An automatic bag-loading device, as claimed in claim 10, wherein said bag-loading device comprises, sleeve means mounted on said head of said arm and having a lower end; and connecting means for connecting said lower end of said sleeve to said bag-gripper.

12. An automatic bag-loading device, as claimed in claim 11, comprising, a shaft, carrying said bag-gripper and having an upper end;

first roller means located at said upper end of said shaft;

second roller means vertically and laterally spaced with respect to the first roller means so as to be located above said upper end of said shaft;

and a pivot bar having a head extending parallel to said shaft.

13. An automatic bag-loading device, as claimed in claim 10, wherein said synchronizing device comprises, a first inverted U-shaped channel mounted on said bag-filling machine;

a second inverted U-shaped channel supported by said first channel mounted in a manner to contact said first channel and extends as a continuation of said first channel forming a conical-shaped curve with an enlarged outer end;

rollers connected to said bag-gripper; and elevating means for alternately elevating and lowering said second channel angularly in relation to said first channel.

* * * * *